United States Patent [19]

Blaskowski

[11] 4,279,296

[45] Jul. 21, 1981

[54] SEGMENTED RING HEADER

[75] Inventor: Henry J. Blaskowski, West Simsbury, Conn.

[73] Assignee: Combustion Engineering, Inc., Windsor, Conn.

[21] Appl. No.: 19,021

[22] Filed: Mar. 8, 1979

[51] Int. Cl.[3] ..... F28F 7/00; F28F 9/26

[52] U.S. Cl. ..... 165/134 R; 165/143

[58] Field of Search ..... 165/141, 143, 144; 122/32, 34; 176/60

[56] References Cited

U.S. PATENT DOCUMENTS

| | | | |
|---|---|---|---|
| 2,656,157 | 10/1953 | Wasielewski | 165/134 |
| 3,923,008 | 12/1975 | Beckmann et al. | 122/34 |

FOREIGN PATENT DOCUMENTS

| | | | |
|---|---|---|---|
| 407177 | 11/1974 | U.S.S.R. | 165/143 |

*Primary Examiner*—Samuel Scott
*Assistant Examiner*—Theophil W. Streule, Jr.
*Attorney, Agent, or Firm*—William W. Habelt

[57] ABSTRACT

A segmented ring header is disposed between and welded to two pressure containment vessels. The segmented ring header comprises a first hemi-toroidal shell having a plurality of openings around its inner circumference shaped to mate with heat transfer tubes lining the first pressure containment vessel, a second hemi-toroidal shell having a plurality of openings around its inner circumference shaped to mate with heat transfer tubes lining the second pressure containment vessel, and a flat ring-shaped plate disposed between the first and second hemi-toroidal shells and welded therebetween. Both the first and second hemi-toroidal shells also have a plurality of openings along their outer circumference for directing the cooling fluid to a collection drum located outside of the pressure containment vessels. The hemi-toroidal shells are circumferentially welded to their respective pressure vessels along a locus located radially between the plurality of openings along the inner circumference of the shell and the plurality of openings along the outer circumference of the shell.

3 Claims, 3 Drawing Figures

SEGMENTED RING HEADER

BACKGROUND OF THE INVENTION

This invention relates to a high pressure gas cooler of the type having at least two cylindrical pressure containment vessels disposed in series with respect to gas flow and, more particularly to an apparatus for collecting the fluid discharging from heat exchange tubes lining the pressure containment vessel and directing that fluid to a fluid collection drum disposed outside of the pressure vessel without penetrating through the pressure vessel wall.

It is often necessary to cool a high pressure hot gas by passing it in heat exchange relationship with a cooling fluid such as water or steam without the two fluids coming into contact. This is frequently done by submerging heat exchange surface in one or more pressure containment vessels through which the gas will pass and passing the cooling fluid through the heat exchange surface such that the fluid and gas pass along opposite sides of the heating surface and heat is transferred from the gas to the cooling fluid across the heating surface. In many cases, the gas to be cooled will be at a pressure as high as 1500 psi and at a temperature in excess of 3000° F. Accordingly, the pressure containment vessels will be relatively thick walled. Consequently, severe temperature gradients will exist through the pressure vessel walls because of the substantial temperature differential between the ambient atmosphere outside of the shell and the hot gas passing through the shell, unless the pressure vessel is cooled to a uniform temperature.

A common method of cooling a pressure vessel wall is to pass a cooling fluid such as water through a plurality of heat transfer tubes lining the interior of the pressure vessel wall. As the cooling fluid flows through the wall, the fluid will absorb the radiative heat from the hot gas thereby protecting the pressure vessel wall from exposure to the hot gas and evaporate to form steam so that the pressure vessel wall is maintained uniformly along its length at the saturation temperature. By maintaining the interior surface of the pressure vessel wall at the saturation temperature, the temperature gradient through the pressure vessel wall is reduced to a level well within the design tolerance of the wall.

A problem associated with cooling the pressure vessel wall in this manner is that the cooling fluid passing through the heat transfer tubes lining the vessel wall must be directed to a collection drum outside of the pressure vessel. Consequently, a plurality of penetrations through the pressure vessel must be provided in order that the cooling fluid may be directed to the collection drum. Stresses within the pressure vessel wall tend to concentrate at these penetrations and over a period of time can result in failure of the pressure vessel wall. Further, nozzles and thermal sleeves of elaborate construction must be provided at these pentrations in order to accommodate differential thermal expansion between the vessel wall and the tubes penetrating therethrough.

Accordingly, it is the object of this invention to provide a ring header of unique design which allows the cooling fluid passing through the heat transfer tubes lining the pressure vessel to be collected and directed to a collection drum disposed outside of the pressure vessel without a single penetration of the pressure vessel wall.

SUMMARY OF THE INVENTION

The present invention provides a segmented ring header which is disposed and welded between two pressure containment vessels aligned in series with respect to gas flow so as to provide a continuous integral pressure containment structure. At the same time, the ring header provides a reservoir for collecting the cooling fluid discharging from the heat transfer tubes lining each of the pressure containment vessels and means for directing the cooling fluid to a collection drum disposed outside of the vessels without a single penetration of the wall of either pressure containment vessel, thereby ensuring the structural integrity of the vessels.

According to the invention, the segmented ring header comprises a first hemi-toroidal shell having a plurality of openings around its inner circumference shaped to mate with the heat transfer tubes lining the first pressure containment vessel, a second hemi-toroidal shell having a plurality of openings around its inner circumference shaped to mate with the heat transfer tubes lining the second pressure containment vessel, and a flat ring-shaped plate disposed between the first and second hemi-toroidal shells and welded therebetween. In this manner, the segmented ring header is formed with two fluid reservoirs, one on each side of the plate for collecting the cooling fluid discharging from the heat transfer tubes which mate to the openings around the inner circumference of each of the hemi-toroidal shells. Both the first and the second hemi-toroidal shells also have a plurality of openings along their outer circumference which mate to riser tubes for directing the cooling fluid collected in the reservoirs to a collection drum which is located outside of the pressure containment vessels.

The first hemi-toroidal shell is disposed concentric to the gas outlet of the first pressure containment vessel and circumferentially welded thereto. Similarly, the second hemi-toroidal shell is disposed concentric to the gas inlet of the second pressure containment vessel and circumferentially welded thereto. Because the hemi-toroidal shells are circumferentially welded to their respective pressure vessels along a locus located radially between the plurality of openings along the inner circumference of the shell and the plurality of openings along the outer circumference of the shell, the cooling fluid can be directed to the collection drum without penetrating either pressure vessel wall. A continuous pressure containment structure is formed by the wall of the first vessel, the wall of the second vessel, and the inner circumferential surface of the ring header welded therebetween.

DESCRIPTION OF THE PREFERRED EMBODIMENT

Figure 1:
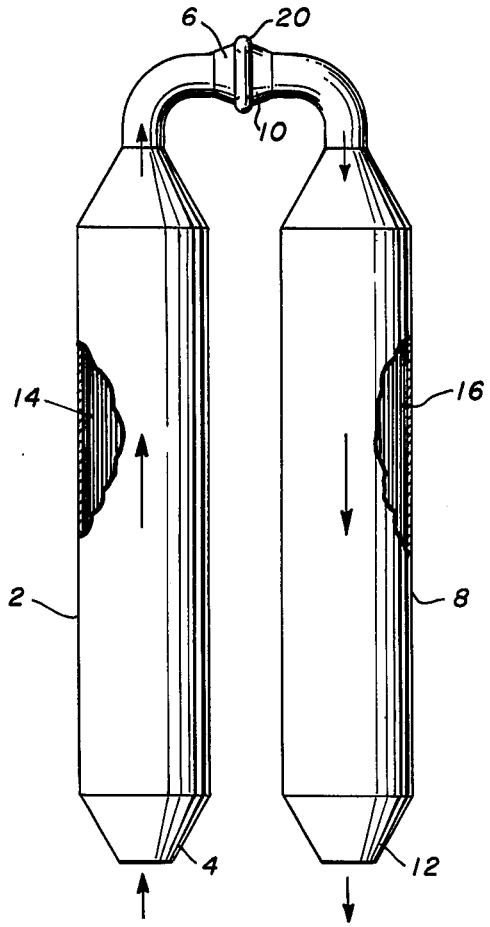
FIG. 1 is a general arrangement view of a high pressure gas cooler incorporating a segmented ring header designed in accordance with the teachings of the present invention.

The high pressure gas cooler shown in FIG. 1 constitutes a representative means of cooling a high pressure, hot gas while incorporating a ring header designed in accordance with the teachings of the present invention. The hot gas to be cooled passes into a first cylindrical pressure containment vessel 2 through gas inlet 4 and exits therefrom through gas outlet 6. The first cylindrical pressure containment vessel 2 typically defines a radiation chamber for the cooling of the hot gas by a radiative heat transfer through a plurality of heat transfer tubes 14 which line the interior thereof. Occasionally, the first pressure containment vessel 2 may also have additional heat exchange surface suspended therein. The hot gas leaving the first cylindrical pressure containment vessel 2 exits therefrom through gas outlet 6 and enters a second cylindrical pressure containment vessel 8 through gas inlet 10. The second cylindrical pressure containment vessel 8 typically houses a series of convective heat transfer surfaces suspended therein. The second cylindrical pressure containment vessel is also lined with a plurality of heat transfer tubes 16 to protect the interior surface of the pressure vessel wall from the hot gas flowing therethrough. The hot gas exits the second cylindrical pressure containment vessel through gas outlet 8 passing to further gas coolers or to other gas processing equipment.

Figure 2:
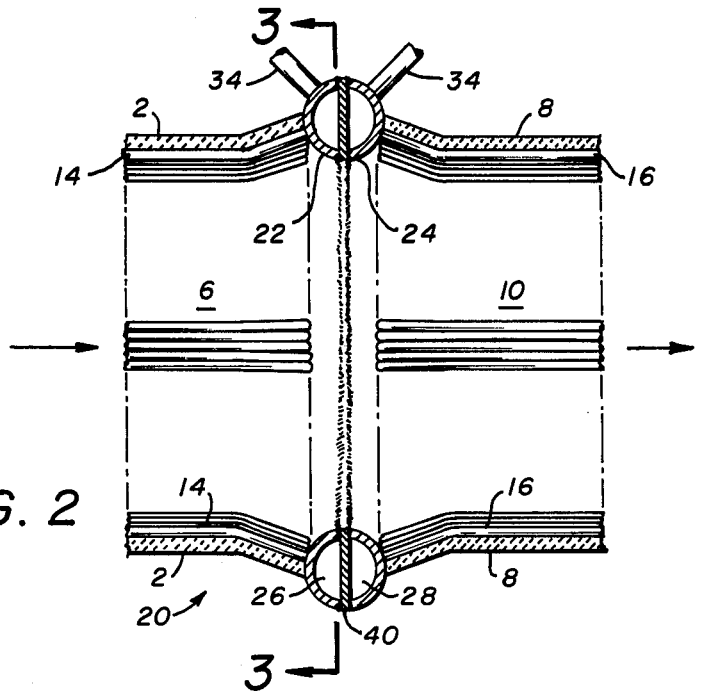
FIG. 2 is an enlarged sectional side view of that portion of the high pressure gas cooler of FIG. 1 which embodies a segmented ring header designed in accordance with the teachings of the present invention.

In accordance with the invention, a segmented ring header 20 is disposed between and concentric to the gas inlet 6 of the first cylindrical pressure containment vessel 2 and the gas inlet 10 of the second cylindrical pressure containment vessel 8. A detailed description of ring header 20 can best be presented by reference to FIGS. 2 and 3 of the drawings.

Ring header 20 is formed by rigidly joining a first hemi-toroidal shell 22 to a second hemi-toroidal shell 24, thereby providing within a toroidal reservoir for collecting the fluid discharging from heat exchanger tubes 14 and 16 which line pressure vessels 2 and 8 respectively. In the preferred embodiment of ring header 20, a flat ring-shaped plate 40, disposed between first hemi-toroidal shell 22 and second hemi-toroidal shell 24, serves as a means for rigidly joining hemi-toroidal shells 22 and 24 together. One side of plate 40 is welded along its outer circumference to the outer circumference of the first hemi-toroidal shell 22 and along its inner circumference to the inner circumference of the first hemi-toroidal shell 22. The other side of plate 20 is welded along its outer circumference to the outer circumference of the second hemi-toroidal shell 24 and along its inner circumference to the inner circumference of the second hemi-toroidal shell 24.

Figure 3:
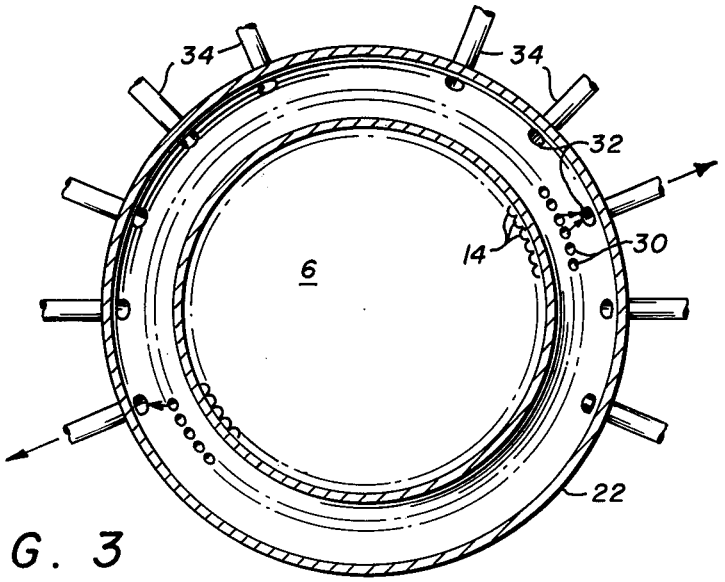
FIG. 3 is a sectional view of the segmented ring header along line 3—3 of FIG. 2.

As shown in FIG. 3, the first hemi-toroidal shell 22 has a plurality of openings 30 circumferentially disposed along a locus near its inner circumference, openings 30 adapted to mate with heat transfer tubes 14 lining the interior of the first pressure vessel 2. The cooling fluid passed through heat exchange tubes 14 in order to protect the interior surface of the first pressure vessel 2 from the hot gas passing therethrough discharges from heat exchange tubes 14 through openings 30 and collects in reservoir 26 formed between the inner surface of the first hemi-toroidal shell 22 and plate 40.

Likewise, the second hemi-toroidal shell 24 has a plurality of similar openings circumferentially disposed along a locus near its inner circumference, said openings adapted to mate with the heat transfer tubes 16 lining the interior of the second pressure vessel 8. The cooling fluid passed through heat exchange tubes 16 in order to protect the interior surface of the second pressure vessel 8 from the hot gas passing therethrough discharges from heat exchange tubes 16 through said openings and collects in reservoir 28 formed between the inner surface of the second hemi-toroidal shell 24 and plate 40.

The cooling fluid collected in reservoirs 26 and 28 is directed to a collecting drum, not shown, located outside of pressure vessels 2 and 8 through a plurality of riser tubes 34. As shown in FIG. 3, the first hemi-toroidal header 22 has a plurality of openings 32 circumferentially disposed along the locus near its outer circumference, openings 32 adapted to mate with riser tubes 34. Similarly, the second hemi-toroidal header 24 has a plurality of openings circumferentially disposed along the locus near its outer circumference which are also adapted to mate with riser tubes 34.

Ring header 20 is disposed between the first pressure containment vessel 2 and the second pressure containment vessel 8 and welded therebetWeen to provide a continuous integral pressure containment structure. According to the invention, a first hemi-toroidal shell 22 of ring header 20 is disposed concentric to the gas outlet 6 of the first pressure containment vessel 2 so as to mate openings 30 along its inner circumference with heat transfer tubes 14 and is circumferentially welded thereto along the locus located radially between the plurality of openings 30 along its inner circumference and the pluratlity of openings 32 alongs its outer circumference. The second hemi-toroidal shell 24 of ring header 20 is disposed concentric to the gas outlet 10 of the second pressure containment vessel 8 and welded thereto in a like manner.

Thus, the present invention provides a means for directing the cooling fluid which is passed through the heat transfer tubes lining the interior of each of the pressure containment vessels 2 and 8 without a single penetration of the vessel walls. A continuous pressure containment structure is formed by the first pressure vessel 2, the second pressure vessel 8, and the inner circumferential surface of ring header 20. The cooling fluid collected in ring header 20 is directed to the outside through the openings in the outer circumferential surface of ring header 20 thereby eliminating the necessity of penetrating the pressure vessels in order to remove the cooling fluid.

What is claimed is:

1. In a high pressure gas cooler having a first cylindrical pressure containment vessel having a gas inlet at one end and a gas outlet at the other end and a plurality of heat exchange tubes lining the interior thereof, a second cylindrical pressure containment vessel having a gas inlet at one end and a gas outlet at the other end and a plurality of heat exchange tubes lining the interior thereof, the gas inlet of said second vessel being in communication with the gas outlet of said first vessel, and means for circulating a fluid through the exchange tubes lining said first and second vessels; and apparatus for collecting the fluid discharging from the heat exchange tubes lining said first and second vessels and directing the fluid to said fluid collection drum comprising:

a. a first hemi-toroidal shell having a plurality of openings around its inner circumference shaped to mate with the heat exchange tubes lining said first vessel, said first hemi-toroidal shell disposed concentric to the gas outlet of said first vessel and welded thereto;

b. a second hemi-toroidal shell having a plurality of openings around its inner circumference shaped to mate with the heat exchange tubes lining said first vessel, said second hemi-toroidal shell disposed concentric to the inlet of said second vessel and welded thereto;

c. means for rigidly joining said first hemi-toroidal shell to said second hemi-toroidal shell thereby providing a reservoir for collecting the fluid discharging from the heat exchange tubes; and d. means for conveying the fluid from said reservoir to a fluid collection drum.

2. An apparatus as recited in claim 1 wherein said means for rigidly joining said first hemi-toroidal shell to said second hemi-toroidal shell comprises a flat ring-shaped plate disposed between said first and second hemi-toroidal shells, one side of said plate welded along its outer circumference to the outer circumference of said first hemi-toroidal shell and along its inner circumference to the inner circumference of said first hemi-toroidal shell, and the other side of said plate welded along its outer circumference to the outer circumference of said second hemi-toroidal shell and along its inner circumference to the inner circumference of said second hemi-toroidal shell.

3. An apparatus as recited in claim 2 wherein said means for conveying the fluid from said reservoir to a fluid collection drum comprises a plurality of openings around the outer circumference of said first hemi-toroidal shell; a plurality of openings around the outer circumference of said second hemi-toroidal shell; and a plurality of riser tubes, one end of each of said riser tubes mating to one of said openings and the other end of each of said riser tubes to a collection drum.

* * * * *